US005695358A

United States Patent [19]

Myer et al.

[11] Patent Number: 5,695,358

[45] Date of Patent: Dec. 9, 1997

[54] ELECTRICAL CONNECTOR WITH STRAIN RELIEF FOR A BUNDLE OF WIRES

[75] Inventors: John Mark Myer, Millersville; John Raymond Shuey, Mechanicsburg, both of Pa.

[73] Assignee: The Whitaker Corporation, Wilmington, Del.

[21] Appl. No.: 699,675

[22] Filed: Aug. 15, 1996

Related U.S. Application Data

[63] Continuation of Ser. No. 495,779, Jun. 27, 1995, abandoned.

[51] Int. Cl.[6] ..... H01R 13/58

[52] U.S. Cl. ..... 439/468; 439/942; 439/456

[58] Field of Search ..... 439/468, 456, 439/459, 460, 470, 473, 466, 467, 942

[56] References Cited

U.S. PATENT DOCUMENTS

| | | | |
|---|---|---|---|
| 3,997,234 | 12/1976 | Worman | 339/105 |
| 4,062,610 | 12/1977 | Doty et al. | 339/75 M |
| 4,095,870 | 6/1978 | Mathe | 439/459 |
| 4,838,809 | 6/1989 | Mouissie | 439/467 |
| 4,952,168 | 8/1990 | Schieferly et al. | 439/467 |
| 5,015,200 | 5/1991 | Abernethy | 439/357 |
| 5,064,967 | 11/1991 | Singbartl | 174/52.3 |
| 5,136,196 | 8/1992 | Schmidt | 310/71 |
| 5,181,862 | 1/1993 | Hawk et al. | 439/595 |
| 5,259,785 | 11/1993 | Inaba et al. | 439/466 |
| 5,271,739 | 12/1993 | Denlinger et al. | 439/466 |
| 5,282,760 | 2/1994 | Armasso | 439/466 |
| 5,290,176 | 3/1994 | Soes et al. | 439/398 |
| 5,380,220 | 1/1995 | Okabe | 439/456 |
| 5,409,396 | 4/1995 | Bowen et al. | 439/470 |
| 5,425,657 | 6/1995 | Davis et al. | 439/456 |

*Primary Examiner*—Neil Abrams
*Assistant Examiner*—T. C. Patel
*Attorney, Agent, or Firm*—T. J. Aberle

[57] ABSTRACT

An electrical connector assembly (100) which includes electrical contacts (10) of the insulation displacement type, an inner housing (20), an outer housing (40), and a strain relief member (50). The assembly (100) is assembled by first securely placing the electrical contacts (10) within the inner housing (20) and then inserting the inner housing (20) into the outer housing (40) so that the electrical contacts (10) can be terminated to wires by using the insulation displacement method of wire termination. The inner housing (20) is fully inserted into outer housing (40), and is then in a fully latched position within the outer housing (40). Strain relief member (50) is then mounted to outer housing (40) and includes an abutment flange (55) for ensuring that the inner housing (20) has been fully inserted within outer housing (40). The wires which are terminated to the contacts (10) will extend around an inner wall (53) of the strain relief (50) and will be laced between retainer walls (58) so that strain relief will be provided to the assembly (100).

44 Claims, 6 Drawing Sheets

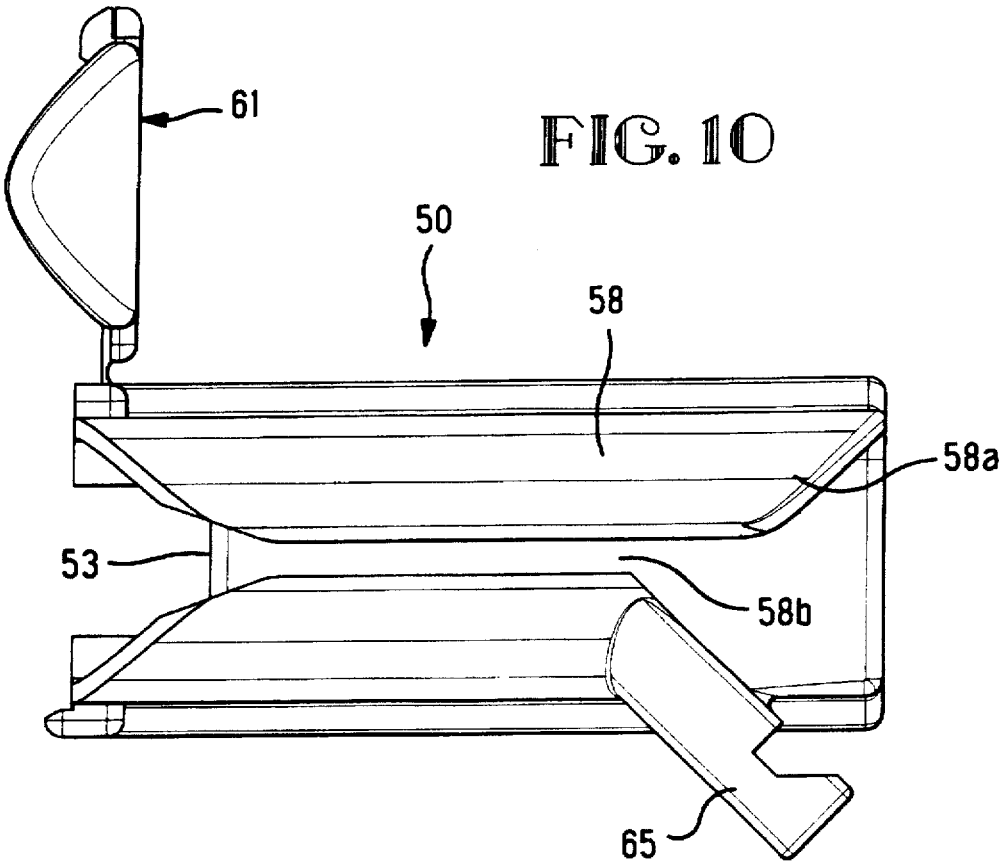
FIG. 10
FIG. 11
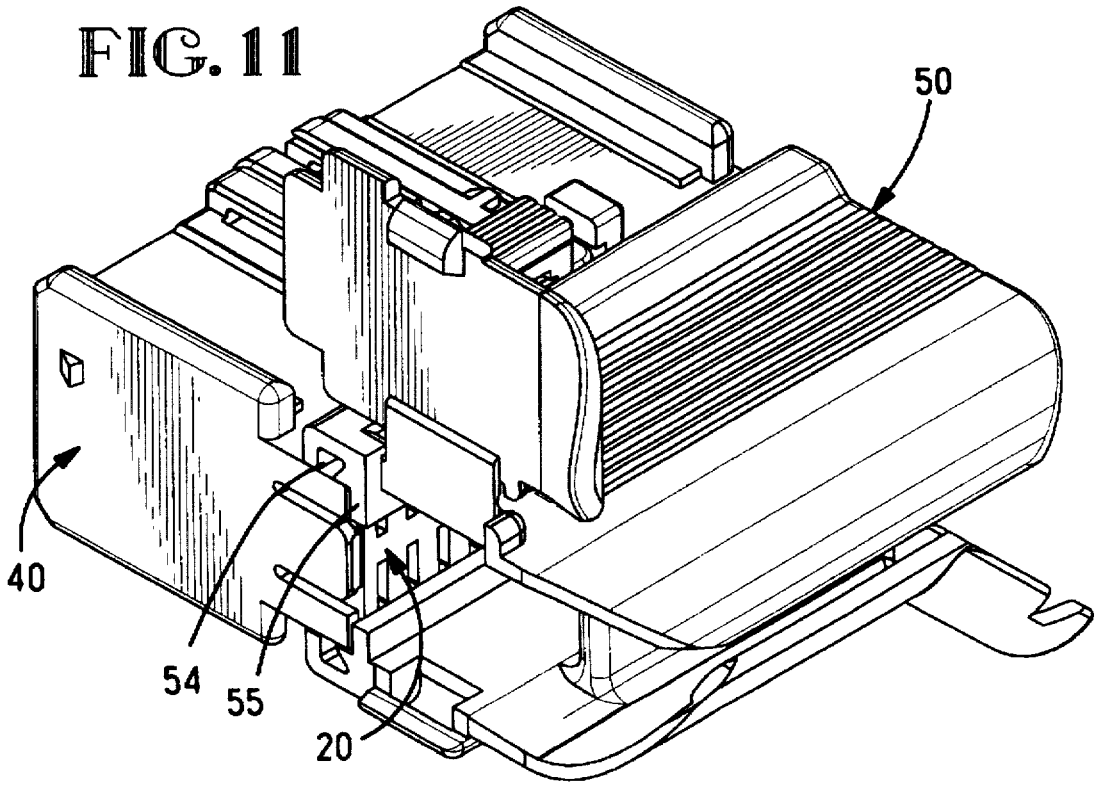

ELECTRICAL CONNECTOR WITH STRAIN RELIEF FOR A BUNDLE OF WIRES

This application is a Continuation of application Ser. No. 08/495,779 filed Jun. 27, 1995, now abandoned.

The present invention relates to an electrical connector assembly having inner and outer housings with electrical contacts, and a strain relief member provided for wires terminated to the contacts. More particularly, the present invention relates to a robust electrical connector assembly for use with insulation displacement (IDC) type contacts whereby termination of the wires preferably occurs after the connector assembly has been partially assembled, and a strain relief member is provided on the assembly for isolating the IDC contacts from forces acting on the wires which would otherwise tend to impair the wire terminations.

This case is related to the inventions embodied in pending docket Nos. 16175 and 16216.

BACKGROUND OF THE INVENTION

A known electrical connector assembly which employs IDC contacts is disclosed in U.S. Pat. No. 5,015,200. An inner housing incorporates pre-terminated IDC contacts and is then inserted into an outer housing header. This connector provides an advantageous low-profile connector assembly; however, the wires must be pre-terminated to the inner housing prior to connection with the header, as the header and inner housing are not adapted to provide termination when the header and inner housing are in a partially assembled state. Additionally, the inner housing does not provide dedicated wire strain relief features, and no further strain relief member is provided in the assembly other than crimp-legs integrally formed on the IDC contacts. Furthermore, the invention does not contemplate a connector position assurance device for ensuring that the inner housing has been fully inserted into the header.

Another known connector assembly is disclosed in U.S. Pat. No. 5,181,862. This assembly is intended to be used in an automotive environment, and includes a header, an inner housing, and a terminal position assurance device. This assembly provides an advantageous way of assuring that electrical interconnections have properly been made; however, the assembly relies on snap-crimp technology, i.e. pre-terminating the wires using crimp technology prior to connection of the wire terminals to the housing. Additionally, the wire strain relief method relies on crimp-legs of the crimp terminals for engaging the wires.

A known IDC terminal is disclosed in U.S. Pat. No. 5,290,176. This known terminal includes a generally U-shaped back-up spring section; however, the IDC terminal is not adapted for use as a retaining means for the IDC terminal within a housing. Other IDC terminals with back-up sections are disclosed in the following U.S. Pat. Nos. 4,159,158; 4,255,009; and 4,408,824.

A known electrical connector assembly which utilizes a strain relief cap for providing strain relief to terminals disposed inside a terminal housing is disclosed in U.S. Pat. No. 4,062,610, the disclosure of which is hereby incorporated by reference in its entirety. This connector contemplates strain relief for a bundle of wires; however, the wires are generally exposed to the environment and they consequently may undergo tangling or be otherwise damaged. Moreover, the strain relief member is mounted to the connector housing by a metallic cam member, which is expensive to manufacture and assemble.

Another electrical connector with dedicated wire strain relief is disclosed in U.S. Pat. No. 5,380,220, which is hereby incorporated by reference in its entirety. This reference discloses an inner housing with wire slots having latching fingers which force a respective wire into a frictionally retained and deformed shape. However, this solution requires crimp-leg strain relief technology, and may cause damage to the wire insulation of small-gauge wires. Additionally, no connector position assurance function is performed by the strain relief structure. Other connectors using strain relief are disclosed in U.S. Pat. Nos. 3,997,234, 5,064,967, and 5,136,196.

The present invention overcomes the deficiencies of the prior assemblies by providing a robust electrical connector assembly wherein the header is adapted to be connected to a strain relief member which protects wires from damage, and performs a connector position assurance function for ensuring that the inner housing has been fully inserted into the header. Moreover, the assembly of the present invention can be formed in a smaller size as compared to prior art connector assemblies because the electrical contacts are preferably formed without the conventional crimp-leg strain relief structure.

SUMMARY OF THE INVENTION

The present invention provides an electrical connector assembly comprising: an inner housing with at least one contact receiving slot; at least one electrical contact disposed in the slot; an outer housing with a cavity for receiving the inner housing, the outer housing includes at least one latch arm for latching the inner housing within the cavity in first and second latched positions; and the inner housing includes a wall for receiving the latching arm in the first and second latched positions. The first position is an intermediate assembly state wherein the electrical contacts are terminated to electrical wires. The inner housing includes a primary latch recess which receives the latch arm in the first latched position, and includes a secondary latch recess which receives the latch arm in the second latched position. Additionally, when the inner housing is disposed in the intermediate, first latched position, a portion of the electrical contact is exposed for the purpose of allowing the termination of electrical wires. In the preferred embodiment of the present invention, the electrical contacts are of the insulation displacement type.

BRIEF DESCRIPTION OF THE DRAWINGS

FIG. 10 shows a rear view of the strain relief member of FIGS. 5, 6.

FIG. 11 shows a rear view of the assembly of FIGS. 7–8.

DETAILED DESCRIPTION OF THE INVENTION

Figure 1:
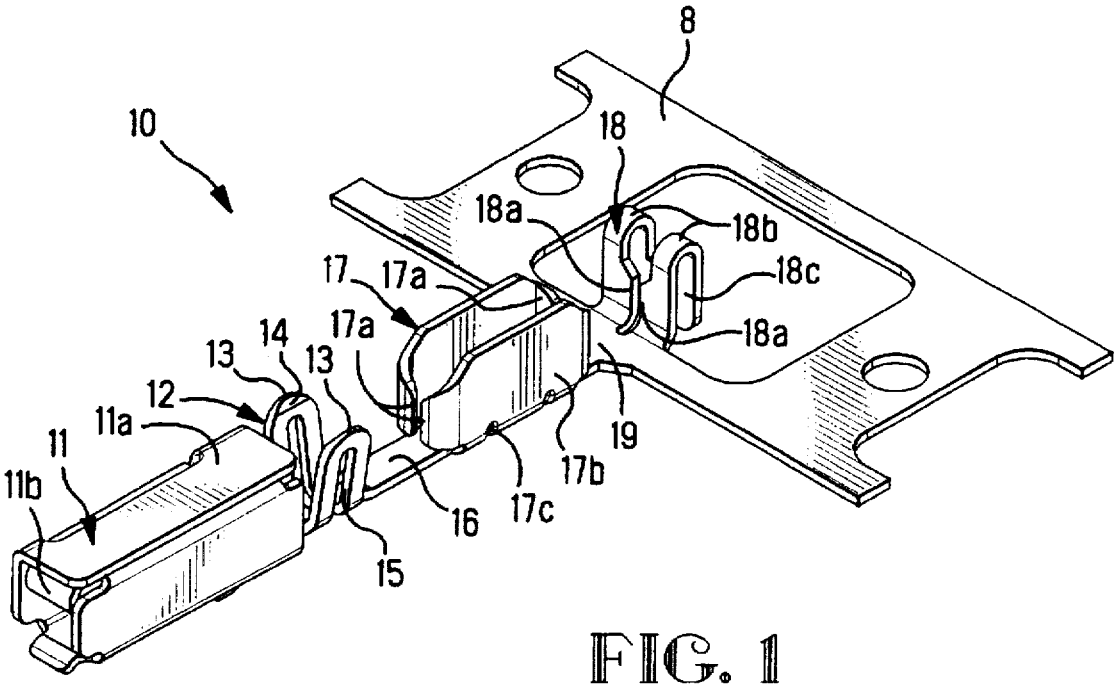
FIG. 1 shows an isometric view of the electrical contact of the present invention while still connected to a carrier strip.

FIG. 1 shows an electrical contact 10 according to the present invention. Contact 10 includes a receptacle section 11 for receiving a pin or blade contact (not shown in the drawing) having a top wall 11*a* and a spring finger 11*b*, a contact retention section 12, a generally box-shaped insulation displacement contact (IDC) section 17, an end IDC section 18 with sharpened blades 18*a* and legs 18*b*, and a carrier strip 8 used for translating the contact 10 through a stamping machine. End IDC section 18 is advantageously formed within the carrier strip 8 during the forming process. Contact retention section 12 includes arcuate beams 13 each having a taper 14 formed thereon. Each arcuate beam 13 includes a slot 15 which extends from one taper 14 to the bottom of contact 10 and then up to the other taper 14, thereby defining, in combination with arcuate beams 13, a flexible joint between the receptacle section 11 and the IDC section 17. This flexibility is desirable as a vibration isolating device. Contact retention section 12 is connected to box IDC section 17 by a middle base portion 16 from which walls 17*b* of IDC section 17 are bent upwardly. Walls 17*b* include divots 17*c* for strengthening the walls and controlling their deflection during termination of a wire. Base portion 16 is advantageously sized to allow a length of wire to extend past box section 17 for permitting a secure electrical termination. On the opposite side of box IDC section 17 relative to base section 16, there is a rear base section 19 which connects the box IDC section 17 with end IDC section 18. Box IDC section 17 includes cutting blades with chamfers 17*a* formed thereon for penetrating the insulation of a wire to be disposed in the contact 10 (not shown in the drawing), and electrically engaging the conductive core of the wire. The blades 18*a* of end IDC section 18 are also shaped to penetrate the insulation of a wire to be terminated in contact 10, and to electrically engage the conductive core of the wire. Blades 17*a* are preferably formed by a coining and stamping process.

Moreover, legs 18*b*, although resilient, are nevertheless adapted to grippingly engage and support the insulation of the wire inserted into contact 10 and to provide a spring assist to blades 18*a*. In this way, end IDC section 18 provides a mechanical and electrical connection to the wire; however, section 18 also provides strain relief of the wire, thereby preserving the electrical termination at IDC section 17 from damage due to forces acting on the wire. Additionally, a gap 18*c* is configured to internally frictionally accommodate a portion of the inner housing 20, as will be described below, thereby axially securing the contact 10 within the inner housing.

Figure 2:
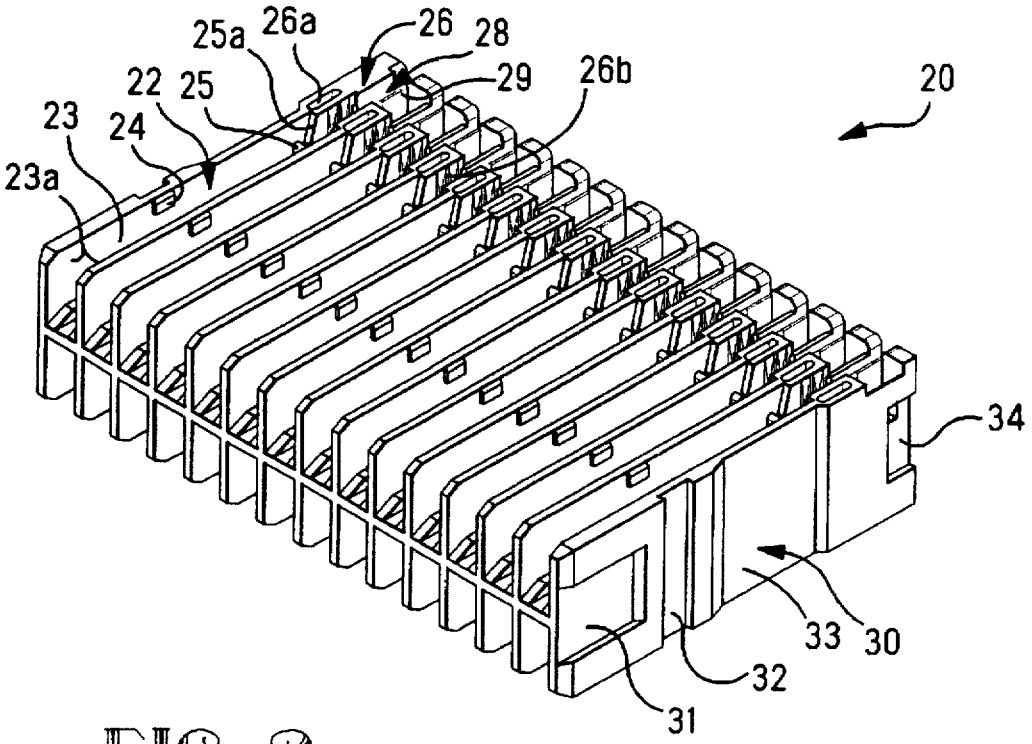
FIG. 2 shows an isometric view of the inner housing according to the present invention.

FIG. 2 shows the inner housing 20 according to the present invention. Inner housing 20 includes a contact slot 22 having a contact receiving section 23 with walls 23*a*, a pair of contact retention embossments 24 (see FIG. 3), and a contact retention clip 25 having a tapered wall 25*a*. Contact receiving slot 22 is sized to receive contact 10 of FIG. 1 so that the receptacle section 11 of contact 10 will be disposed in contact receiving section 23, and the arcuate beams 13 of contact retention section 12 of contact 10 will resiliently engage contact retention embossments 24 thereby providing a vertical retention feature for contact 10. Additionally, gap 18*c* is sized to resiliently receive contact retention clip 25 adjacent to tapered walls 25*a*, which thereby provides an axial retention feature for the contact 10 within inner housing 20.

Figure 3:
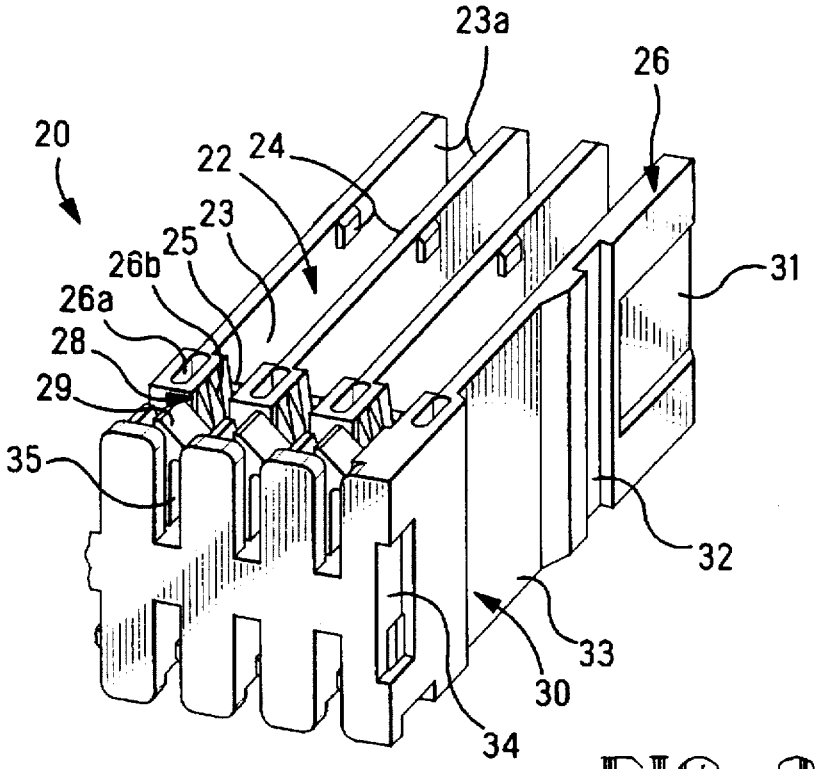
FIG. 3 shows an isometric view of the wire exit portion of the inner housing of FIG. 2.

Inner housing 20 also includes a wall 26 having a void area 26*a* and serrated ridges 26*b* (see FIG. 3). Void 26*a* allows for flexibility of the housing material as a wire inserted into housing 20 will press against serrations 26*b* and thereby tend to close void 26*a*. In another advantage of the invention, the serrations allows for wire strain relief thereby eliminating the need for crimp-leg type strain relief of the prior art. Adjacent to wall 26 a wire exit slot 28 is formed with a latching finger 29 for latchably receiving a wire to be inserted in inner housing 20.

On the outer side of inner housing 20 a side wall 30 is formed, which wall includes a lead-in recess 31, a primary latch recess 32, an intermediate recess 33, and a secondary latch recess 34. Primary latch recess 32 is adapted to receive an outer housing latch for defining a first position of the inner housing 20 whereby wires can be terminated in the IDC sections of contact 10. Secondary latch recess 34 will receive the housing latch after the wire terminations have been completed and the inner housing 20 has been fully inserted into the outer housing, as will be more fully described below.

Referring to FIG. 3 a rear view of the inner housing 20 of FIG. 2 is shown. The position of slot 35 shows where a wire will be vertically and axially retained by serrations 26*b* and latching finger 29, and where the wire will exit from the rear of inner housing 20 after the wire has been terminated in a respective contact 10. It is, however, contemplated that the slot 35 can be formed with a V-shaped profile for enhancing its retaining function.

Figure 4:
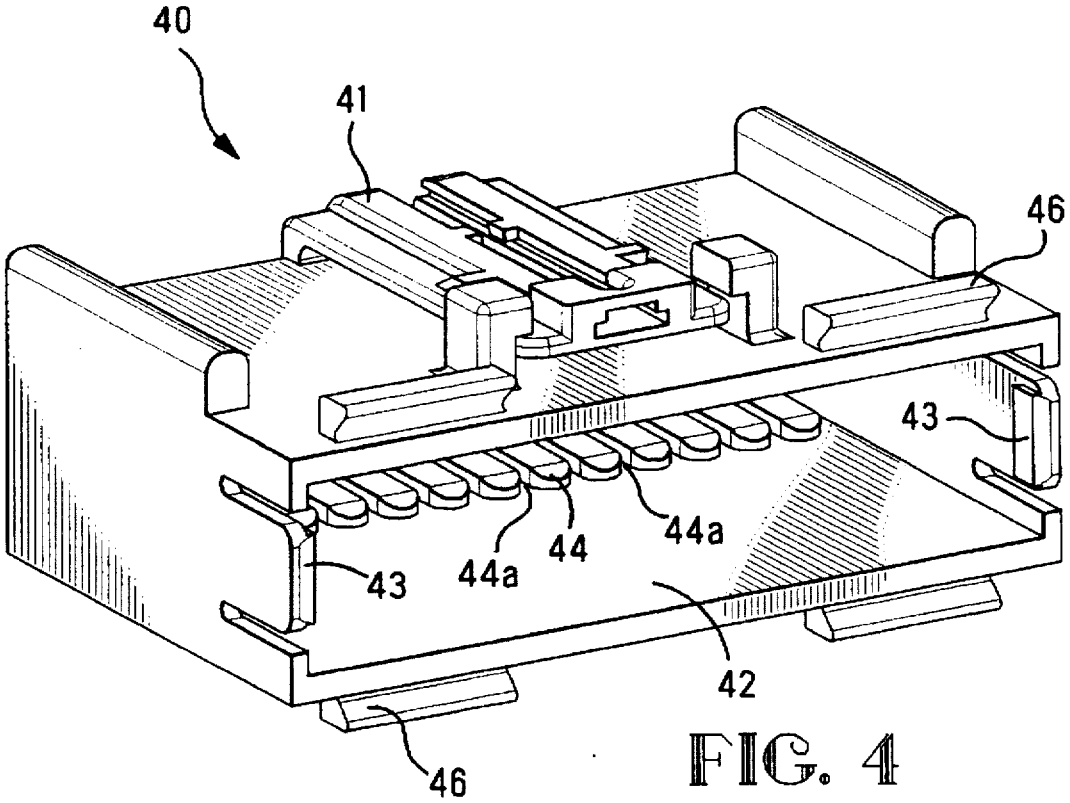
FIG. 4 shows an isometric view of the outer housing according to the present invention.

FIG. 4 shows an outer housing 40 according to the present invention. Outer housing 40 includes a deflectable housing latch arm 41, an aperture 42 for receiving inner housing 20 of FIG. 2 therein, a pair of resilient latch arms, ribs 44, and a plurality of lugs 46. After inner housing 20 has been assembled with electrical contacts 10 therein, inner housing 20 will be inserted into aperture 42 so that latch arms 43 will be received within respective lead-in recesses 31 along the side of inner housing 20.

Next, inner housing 20 will be moved from the lead-in position to the first latched position whereby latch arms 43 will be deflected outwardly so that the latch arms 43 will advance into a latched position within primary latch recess 32. At this point, wires will be terminated into the IDC sections of contact 10 which will result in a plurality of wires exiting from wire slots 35 of inner housing 20. After the wire termination procedure has been completed, the inner housing 20 will be further inserted into aperture 42 of outer housing 40. As this occurs, latch arms 43 will again be deflected outwardly along wall 30 of inner housing 20 and will further advance past intermediate recess 33, and ultimately latching arms 43 will be advanced to their second or final latched position at secondary latch recess 34. At this second latched position, inner housing 20 is fully received and latched within outer housing 40.

When outer housing 40 has thus fully received inner housing 20, it is important to note that contact slot walls 23*a* of inner housing 20 will be inserted into slots 44*a* between ribs 44. Ribs 44 will engage top wall 11*a* of receptacle section 11 of contact 10 and thereby retain the position of contact 10 when the pin or tab engages the spring finger 11*b* of contact section 11. In this way, the contact 10 will not be vertically displaced, and stubbing of the pin or tab contact will be avoided. Finally, housing latch arm 41 is adapted to receive a connector position assurance device (not shown in the drawing) and the outer housing 40 with inner housing 20 therein is received in an aperture of a header member having tab or pin contacts (not shown in the drawing).

Figure 5:
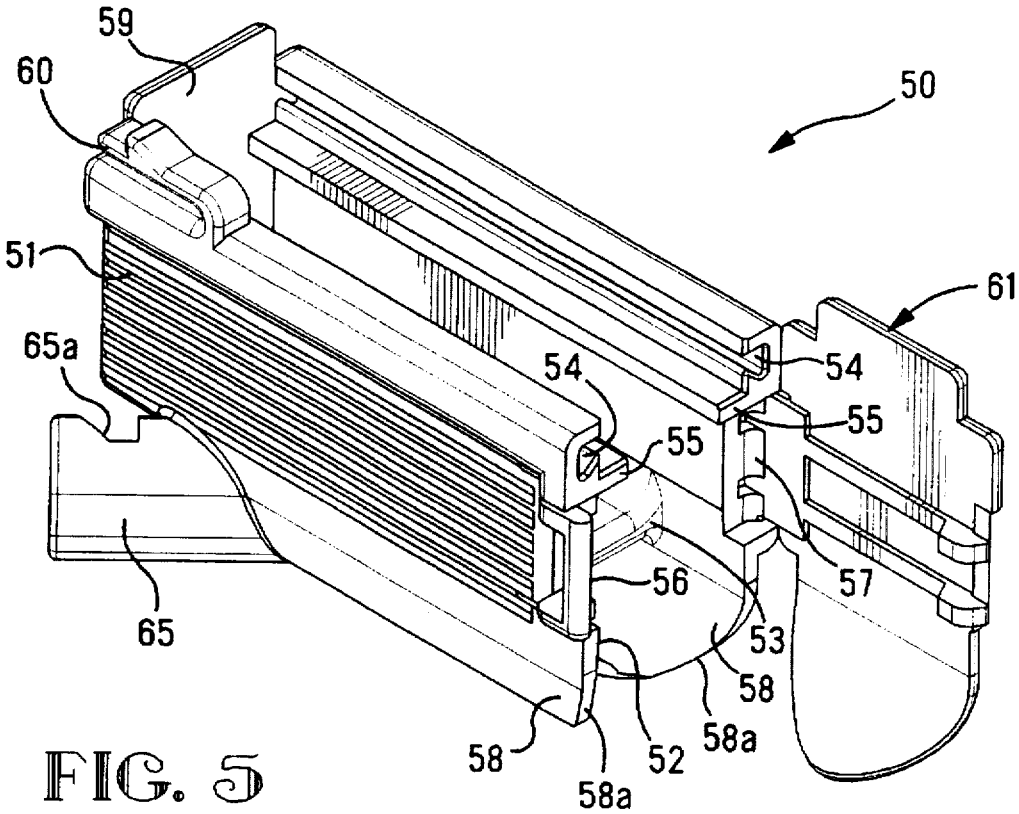
FIG. 5 shows an isometric view of the strain relief member according to the present invention.

FIG. 5 shows a strain relief member 50 for use with the present invention. Strain relief member 50 includes: a top wall 51; a bottom wall 52; an inner wall 53 which extends between top wall 51 and bottom wall 52; a groove 54 which is shaped for receipt of lugs 46 (FIG. 11); a flange 55 which is adapted to abut the inner housing 20 if the inner housing is not fully in place within outer housing 40, which thereby acts as a connector position assurance device (FIG. 11); a latch 56 formed adjacent to slits for allowing flexibility of the latch; a hinge 57; flexible retainer walls 58 having arcuate edges 58*a* for receiving and retaining a plurality of wires therein, and having at least a slit or gap 58*b*(FIG. 10); and a side wall 59 which acts as a stop for engaging the side of outer housing 40. Additionally, a resilient latching arm 60 is provided on a front face of strain relief member 50 for latching the strain relief member in place on the housing 40 (see FIG. 8). Moreover, it is contemplated that the wall 53 can be formed with a punch-out section for the purpose of receiving wires therethrough when a "short-cut" wiring route is needed as, for example, when a wire has been shortened due to breakage. Furthermore, it is contemplated that flexible walls 58 can be provided with strengthening ribs for the purpose of controlling the flexibility of the walls under certain environmental conditions, e.g. high vibration or temperature.

Figure 6:
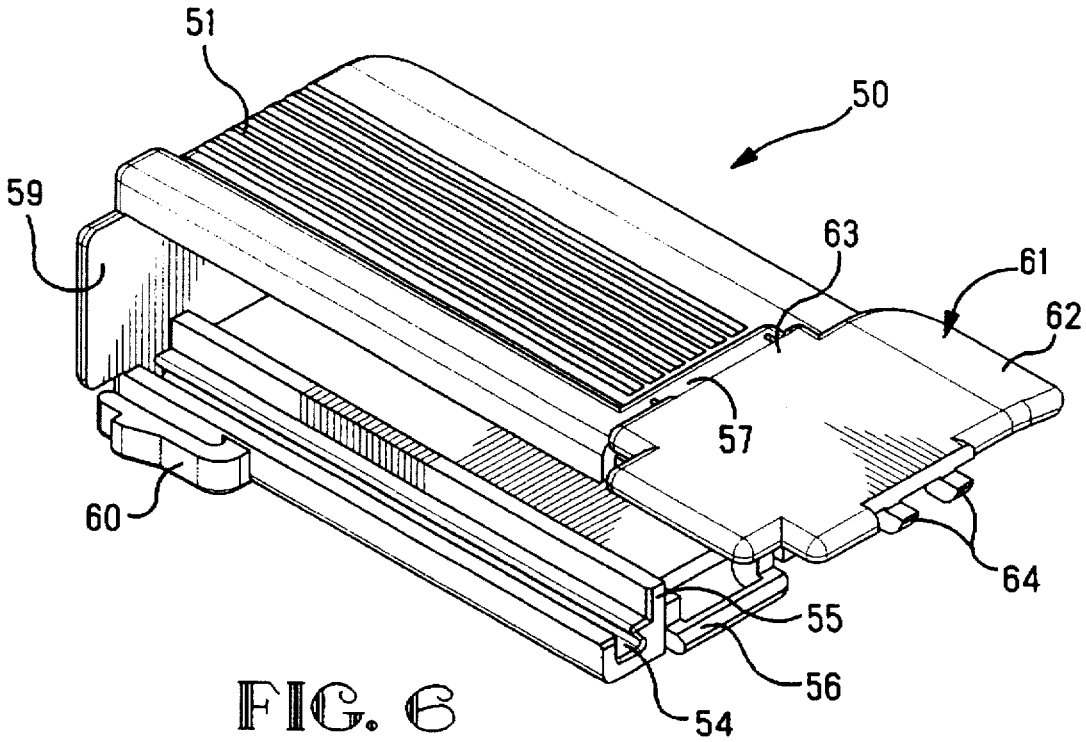
FIG. 6 shows an isometric view of the strain relief member of FIG. 5 but with a cover mounted on an end thereof.

FIG. 6 shows the strain relief member of FIG. 5 but with a cover 61 installed on hinge 57 adjacent to hinge area 63. Lugs 64 lockingly engage latch bar 56 when the cover 61 is in a closed position. Retainer walls 58 include arcuate sections 58*a* with a gap 58*b* for forcing a bundle of wires between walls 58 toward inner wall 53 (see FIG. 5).

Figure 7:
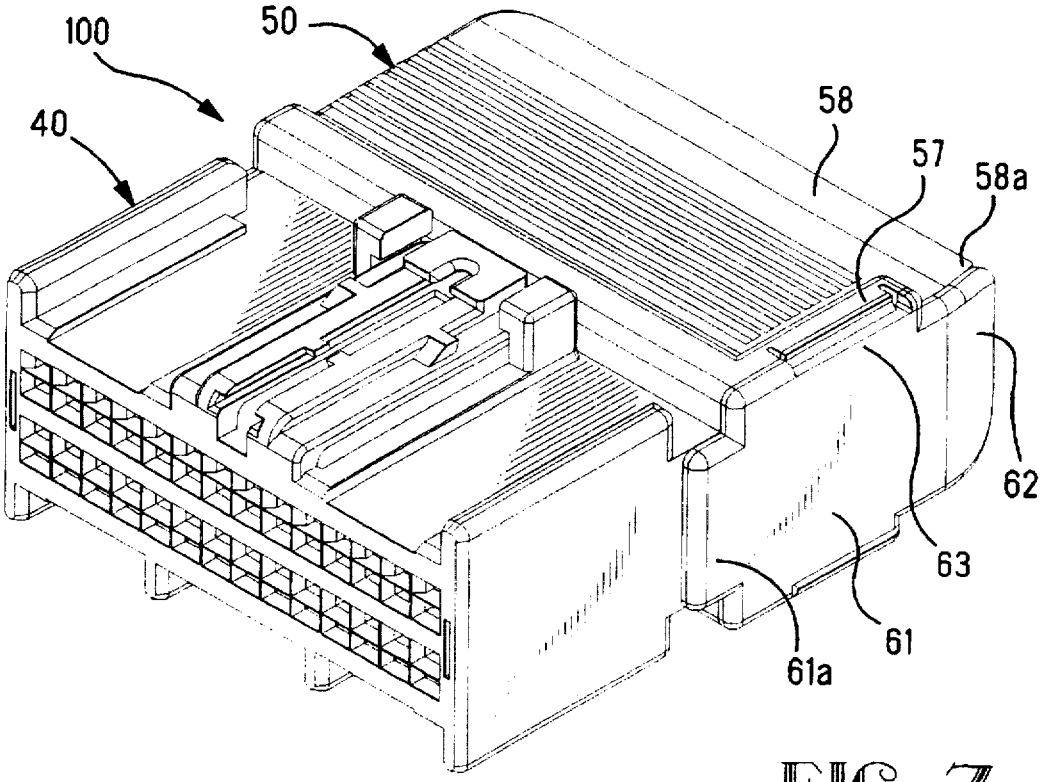
FIG. 7 shows an isometric view of the strain relief member of FIG. 6 mounted to the outer housing of FIG. 4.

FIG. 7 shows a connector assembly 100 comprising the strain relief member 50 installed on outer housing 40 with the cover 61 in a closed position, and the inner housing installed in outer housing 40 with contact 10 therein (not shown). When the connector 100 is fully assembled with wires terminated in contact 10 and the inner housing 20 is in a fully latched, second position within outer housing 40, the wires will protrude out of the back of inner housing 20. The wires will be disposed in a tortuous path as they will: exit the inner housing 20; turn 90 degrees toward cover 61; be laced around inner wall 53 in a 180 degree turn; be guided by arcuate wall 62 of cover 61 in the 180 degree turn; and will be forcibly laced in gap 58*b* between and within retainer walls 58 (see FIG. 5). Thus the wires will be snugly disposed in strain relief member 50 so that the tortuous path will absorb any forces acting on the wires externally of the connector assembly 100. This strain relief feature contributes to the elimination of the need for prior art type crimp-leg strain relief.

Figure 8:
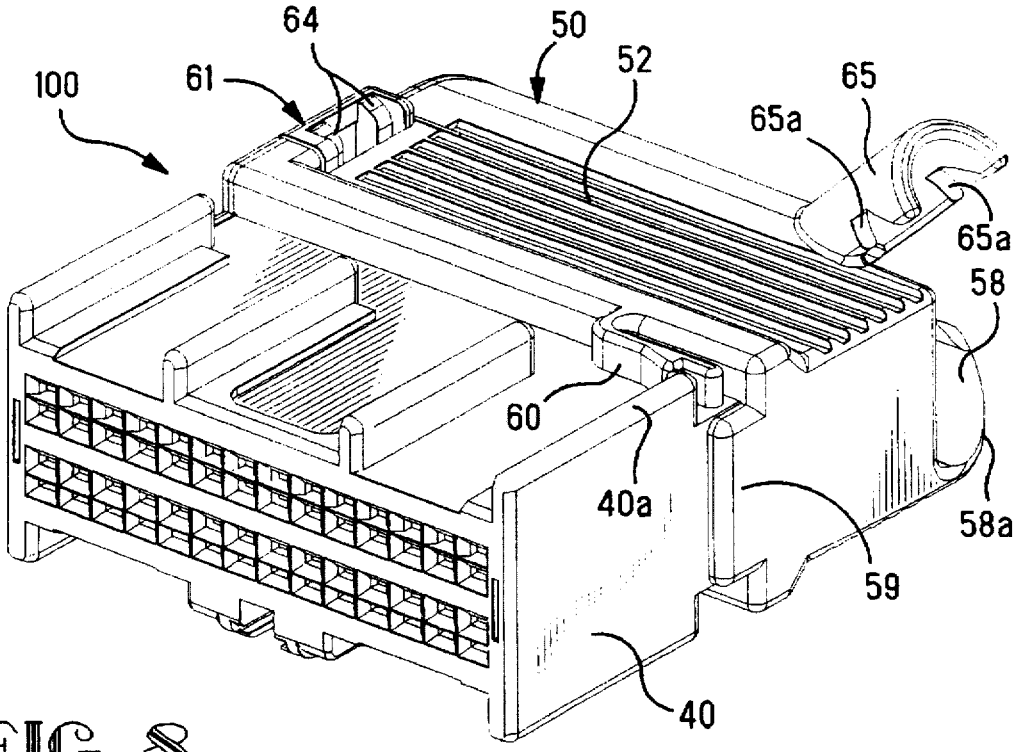
FIG. 8 shows the outer housing and strain relief member of FIG. 7 rotated 180° about a contact insertion axis.

As shown in FIG. 8, which is a bottom view of the connector assembly 100 of FIG. 7, the wires will then extend out of wire trough 65. Wire trough 65 includes a notch area 65*a* for preferably receiving a tie-wrap therearound (not shown in the drawing) thereby tightly securing and supporting the wires to trough 65 and strain relief member 50.

Figure 9:
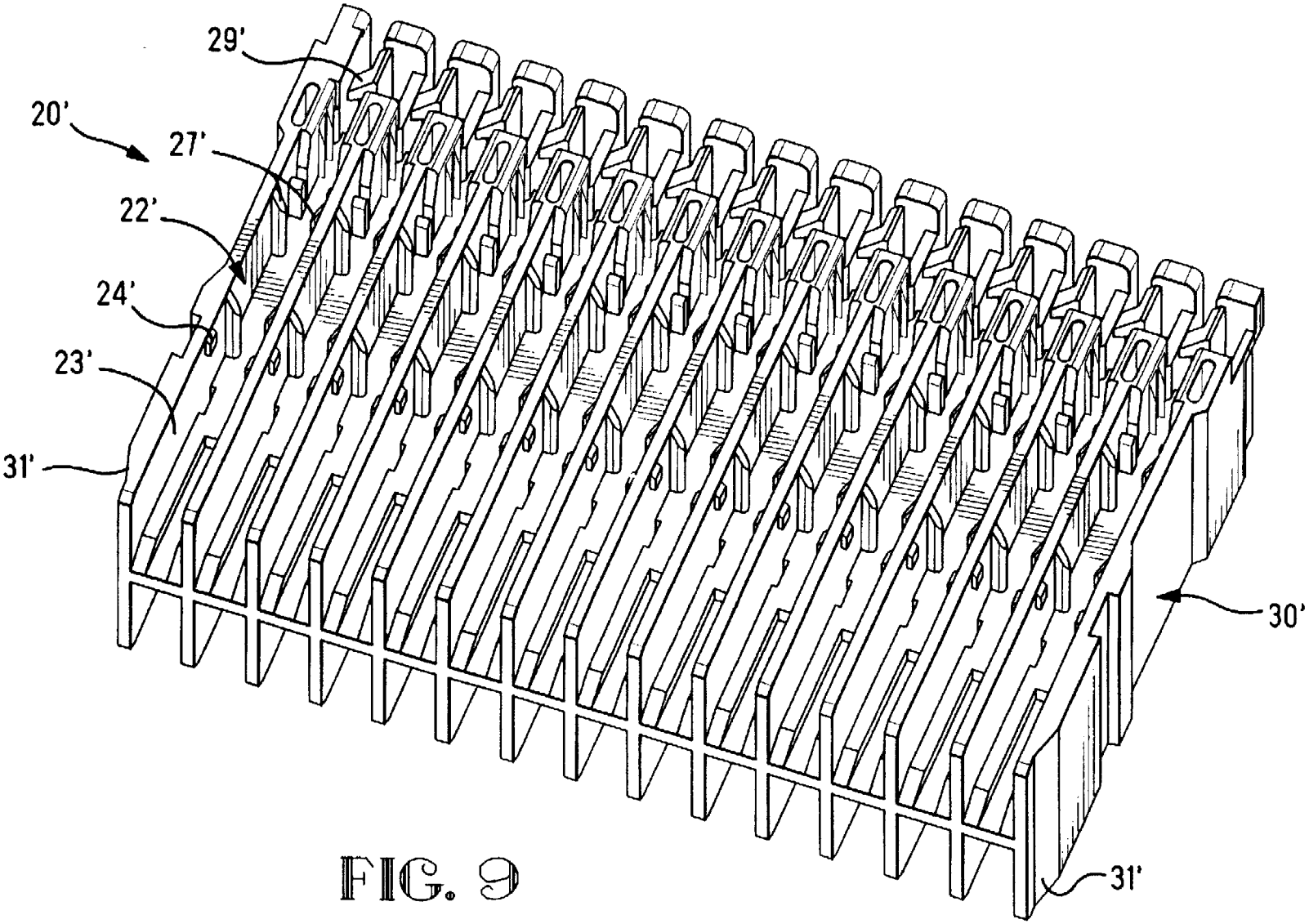
FIG. 9 shows an alternative embodiment of the inner housing of FIG. 2.

Now referring to FIG. 9, an alternative embodiment 20' of the inner housing 20 will be described. The essential differences between the inner housing embodiments 20,20' are as follows: slot 22' is shown with contact receiving slot 23' having embossments 24' in a staggered configuration to facilitate the molding process; wire guides 27' have been added to slot 22' for the purpose of guiding and retaining a wire to be terminated in contact 10, the guides 27' are in the form of ribs and are spaced to have the box IDC section 17 disposed therebetween when the contact 10 is in place; latching finger 29' is reconfigured to facilitate the molding process; and lead in ramps 31' are arranged for guiding the outer housing latch 41.

The preferred engineering material for the electrical contact 10 will comprise a metal having sufficient spring characteristics, high strength, high conductivity, and a low cost. For example, the contacts are preferably formed of such metals as copper, brass, bronze, beryllium copper, copper alloys, steel, nickel, aluminum, and zinc. It is further contemplated that the electrical contacts can be coated or plated for corrosion resistance. Additionally, it is contemplated that the inner housing, outer housing, and strain relief member will be formed of a suitable dielectric material, for example: the inner housing is preferably made of an unfilled PBT, while the outer housing is a filled PBT material, e.g. a 30% glass filled material, or even a polypropelene material. It is therefore contemplated that the inner housing material will advantageously exhibit a higher degree of compliancy relative to the outer housing material.

Thus, while a preferred embodiment of the invention has been disclosed, it is to be understood that the invention is not to be strictly limited to such an embodiment but may be otherwise variously embodied and practiced within the scope of the appended claims.

Accordingly, what is claimed is:

1. An electrical connector assembly, comprising:

a first housing with at least one contact receiving recess;

a second housing with a cavity for receiving said first housing, said second housing includes at least one lug for engaging a strain relief member at a wire exit side of said first housing;

a strain relief member, said strain relief member is adapted to receive said second housing lug; and said strain relief member is attachable to said second housing in a sliding direction, said sliding direction being generally transverse to a longitudinal direction of said first housing contact receiving recess, and said strain relief member includes a flexible latch beam.

2. The assembly of claim 1, wherein said strain relief member comprises a groove for slidingly receiving said lug.

3. The assembly of claim 1, wherein said strain relief member comprises a wall for guiding wires in a direction which is generally transverse to a longitudinal direction of said first housing contact recess.

4. The assembly of claim 1, wherein said strain relief member includes a flexible latch beam.

5. The assembly of claim 1, wherein said strain relief member includes a hinge.

6. The assembly of claim 1, wherein said strain relief member includes at least one flange which extends at least partially in a direction which is generally transverse to an insertion direction of said first housing relative to said second housing, and said flange is generally parallel to a lug receiving groove of said strain relief member.

7. The assembly of claim 1, wherein said strain relief member includes at least one flange having an end edge which is sized to abut a portion of said first housing, thereby preventing said second housing lug from being received by said strain relief member, when said strain relief member is being mounted on said second housing, if the first housing has not been fully inserted into the second housing.

8. The assembly of claim 1, wherein said strain relief member comprises a pair of flexible walls for guiding a wire in a direction which relieves strain on the wire.

9. The assembly of claim 8, wherein said pair of walls comprises a gap therebetween as wires are being laced between said flexible walls.

10. The assembly of claim 8, wherein said pair of walls comprises a slit between said walls.

11. The assembly of claim 8, wherein at least one of said walls comprises an arcuate surface for slidingly engaging wires.

12. The assembly of claim 1, wherein said strain relief member includes a flexible latch beam and a hinge, and a cover is hingeably mounted to said hinge and the cover is latchable to said latch beam.

13. The assembly of claim 12, wherein said strain relief member includes a first flange for engaging said second housing, and a portion of said second housing abuts said flange when said strain relief member is fully mounted on said second housing.

14. The assembly of claim 12, wherein said cover includes a second flange for engaging a portion of said second housing, and a portion of said second housing is trapped between said flanges when said strain relief member is fully mounted on said second housing with said cover in a closed position for the purpose of guiding and protecting wires.

15. An electrical connector assembly, comprising:

a dielectric housing with at least one lug for engaging a strain relief member at a wire exit side of the housing;

a strain relief member adapted to receive said housing lug, and for relieving strain on wires; and said strain relief member includes a first flange for engaging said housing, and a portion of said housing is aligned to abut said flange when said strain relief member is fully mounted on said housing.

16. The assembly of claim 15, wherein said strain relief member comprises a sliding direction for mounting said strain relief member to said housing.

17. The assembly of claim 15, wherein said strain relief member comprises a groove for slidingly receiving said housing lug.

18. The assembly of claim 15, wherein said strain relief member comprises a wall for guiding wires.

19. The assembly of claim 15, wherein said strain relief member includes a flexible latch beam.

20. The assembly of claim 15, wherein said strain relief member includes a hinge.

21. The assembly of claim 15, wherein said strain relief member includes a flexible latch beam and a hinge, and a cover is hingeably mounted to said hinge and the cover is latchable to said latch beam.

22. The assembly of claim 15, wherein said cover includes a second flange for engaging a portion of said housing, and a portion of said housing is trapped between said flanges when said strain relief member is fully mounted on said housing with said cover in a closed position for the purpose of guiding and protecting wires.

23. The assembly of claim 15, wherein said strain relief member includes at least one flange which extends generally parallel to a lug receiving groove of said strain relief member.

24. The assembly of claim 15, the strain relief member comprises a deflectable latch arm for latching the strain relief member to the housing.

25. The assembly of claim 15, wherein said strain relief member comprises a pair of flexible walls for guiding wires in a direction which relieves strain on the wire.

26. The assembly of claim 25, wherein said pair of walls comprises a gap therebetween as wires are being laced between said flexible walls.

27. The assembly of claim 25, wherein said pair of walls comprises a slit between said walls.

28. The assembly of claim 25, wherein at least one of said walls comprises an arcuate surface for slidingly engaging wires.

29. An electrical connector assembly, comprising:

a housing having a strain relief member area;

a strain relief member associated with said housing, said strain relief member comprises a chamber comprising at least one flexible wall having a free end for slidingly engaging and guiding wires into or out of said chamber, whereby said wires press against a portion of the flexible wall free end, and said wires are operable to thereby displace said free end of the flexible wall as they move into or out of the chamber, after said wires have been so moved, said flexible wall flexes back into generally its original shape said chamber being divided into first and second chambers by an inner wall of said chamber, said inner wall is for guiding said wires in said first and second chambers.

30. The assembly of claim 29, wherein one of said first and second chambers comprises said flexible wall.

31. The assembly of claim 29, wherein said strain relief member comprises a plurality of flexible walls, said walls comprise a gap therebetween for receiving the wires.

32. The assembly of claim 31, wherein said flexible walls comprise respective guiding surfaces for slidingly guiding the wires into said chamber.

33. The assembly of claim 32, wherein said guiding surfaces guide said wires into said gap toward said chamber.

34. An electrical connector assembly, comprising:

a housing having a strain relief area; and a strain relief member associated with said housing, said strain relief member comprises a wire guiding chamber for guiding wires in a direction which relieves strain on the wires, said strain relief member includes a hinged cover, said cover is operative to prevent relative movement between said housing and said strain relief member when said cover is in a secured position about said hinge, and said cover comprises covering sections for covering at least one lug receiving groove of said electrical connector assembly.

35. The assembly of claim 34, wherein said cover secured position traps a portion of said housing between said cover and an opposing section of said strain relief member.

36. The assembly of claim 34, wherein said cover comprises a latching structure for latching with respective latching structure on a wall of said strain relief member for latching the cover in said secured position.

37. The assembly of claim 34, wherein said cover comprises a wire guiding wall section adjacent flexible walls of said strain relief member.

38. An electrical connector assembly, comprising:

a first housing having a contact receiving area; a second housing for assembly with said first housing, said first and second housings comprise an assembly direction of motion for assembly of the housings together;

and a strain relief member associated with said housings, said strain relief member comprises a second housing mounting section for assembling said strain relief member with second housing, said strain relief member and said second housing comprise an assembly direction of motion for assembly of the strain relief member with said second housing, said strain relief member includes at least one wall area comprising a flange for engagement with said first housing which extends at least partially in a direction which is generally transverse to the assembly direction of said first housing relative to said second housing, and if said first housing is incompletely assembled to said second housing, a portion of said first housing will cooperate with said wall area to prevent assembly of said strain relief member to said second housing.

39. The electrical connector assembly of claim 38, wherein when said first housing is fully assembled to said second housing, said wall area is aligned with said first housing for maintaining said first housing in an assembled state relative to said second housing.

40. An electrical connector assembly, comprising:

a first housing with at least one contact receiving recess;

a second housing with a cavity for receiving said first housing, said second housing includes at least one lug for engaging a strain relief member at a wire exit side of said first housing;

a strain relief member, said strain relief member is adapted to receive said second housing lug; and said strain relief member is attachable to said second housing in a sliding direction, said sliding direction being generally transverse to a longitudinal direction of said first housing contact receiving recess, and wherein said strain relief member includes a hinge.

41. An electrical connector assembly, comprising:

a first housing with at least one contact receiving recess;

a second housing with a cavity for receiving said first housing, said second housing includes at least one lug for engaging a strain relief member at a wire exit side of said first housing;

a strain relief member, said strain relief member is adapted to receive said second housing lug; and said strain relief member is attachable to said second housing in a sliding direction, said sliding direction being generally transverse to a longitudinal direction of said first housing contact receiving recess, and wherein said strain relief member includes a flexible latch beam and a hinge, and a cover is hingeably mounted to said latch beam.

42. An electrical connector assembly for termination with electrical wires, said assembly comprising an electrical connector housing having a strain relief member area and a strain relief member associated with said housing strain relief member area, said strain relief member comprises:

(a) first and second wall sections, said first and second wall sections comprise respective housing attaching sections for attaching said strain relief member to said housing;

(b) a side wall section;

(c) a connecting wall section, said connecting wall section is adjacent to said first and second wall sections thereby defining a first chamber of said strain relief member for receiving said wires;

(d) flexible retainer wall sections, said flexible retainer wall sections comprise flexible wall portions which extend adjacent to said connecting wall section towards each other, thereby defining a second chamber of said strain relief member for receiving said wires; and (e) said wires are operative to press against said flexible wall portions while moving into or out of said second chamber, whereby said flexible wall portions separate to accommodate said wires as the wires move into or out of the chamber.

43. An electrical connector assembly for termination with electrical wires, said assembly comprising an electrical connector housing having a strain relief member area and a strain relief member associated with said housing strain relief member area, said strain relief member comprises:

(a) first and second wall sections, said first and second wall sections comprise respective housing attaching sections for attaching said strain relief member to said housing;

(b) a side wall section adjacent said first and second wall sections;

(c) flexible retainer wall sections, said flexible retainer wall sections comprise flexible wall portions which extend adjacent to said first and second wall sections towards each other, thereby defining a wire receiving chamber for receiving said wires; and (d) said wires are operative to press against said flexible wall portions while moving into or out of said chamber, whereby said flexible wall portions separate to accommodate said wires as the wires move into or out of the chamber.

44. An electrical connector assembly for termination with electrical wires, said assembly comprising an electrical connector housing having a strain relief member area and a strain relief member associated with said housing strain relief member area, said strain relief member comprises:

(a) first and second wall sections, said first and second wall sections comprise respective housing attaching sections for attaching said strain relief member to said housing;

(b) a side wall section adjacent said first and second wall sections;

(c) a flexible retainer wall section, said flexible retainer wall section comprises a flexible wall portion which extends away from one of said first and second wall sections, thereby defining a wire receiving chamber for receiving said wires; and (d) said wires are operative to press against said flexible wall portion while moving into or out of said chamber, whereby said flexible wall portion moves relative to said first and second wall sections to accommodate said wires as the wires move into or out of the chamber.

* * * * *